US010423106B2

(12) United States Patent
Makino

(10) Patent No.: US 10,423,106 B2
(45) Date of Patent: Sep. 24, 2019

(54) FIXING DEVICE THAT CONTROLS A POSITION OF A FIXING BELT USING A DISPLACING DEVICE

(71) Applicant: CANON KABUSHIKI KAISHA, Tokyo (JP)

(72) Inventor: Yuichi Makino, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/200,057

(22) Filed: Nov. 26, 2018

(65) Prior Publication Data

US 2019/0171140 A1 Jun. 6, 2019

Related U.S. Application Data

(63) Continuation of application No. PCT/JP2017/020530, filed on May 26, 2017.

(30) Foreign Application Priority Data

May 26, 2016 (JP) ..... 2016-105026

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
See application file for complete search history.

(56) References Cited

U.S. PATENT DOCUMENTS

| | | | |
|---|---|---|---|
| 5,475,194 | A | 12/1995 | Watanabe et al. |
| 9,104,155 | B2 | 8/2015 | Makino |
| 9,195,192 | B2 | 11/2015 | Hasegawa |

FOREIGN PATENT DOCUMENTS

| | | | |
|---|---|---|---|
| JP | H06-175521 | A | 6/1994 |
| JP | 2007-078922 | A | 3/2007 |
| JP | 2013-218054 | A | 10/2013 |
| JP | 2014-089436 | A | 5/2014 |
| JP | 2015-059964 | | 3/2015 |
| WO | 2017/204367 | A1 | 11/2017 |

OTHER PUBLICATIONS

International Search Report and Written Opinion dated Jul. 4, 2017, issued in corresponding International Patent Application No. PCT/JP2017/020530.

*Primary Examiner* — Susan S Lee
(74) *Attorney, Agent, or Firm* — Venable LLP

(57) ABSTRACT

A fixing device includes a detecting device including a contact portion contacting one end of an endless belt with respect to a widthwise direction, an urging portion for urging the contact portion toward the one end of the endless belt with respect to the widthwise direction, and a sensor for detecting a position of the contact portion. The detecting device detects a position of the endless belt with respect to the widthwise direction depending on an output of the sensor. A displacing device displaces one end of the roller with respect to a longitudinal direction depending on the position of the endless belt detected by the detecting device. Before rotation of the endless belt is started, the displacing device displaces the one end of the roller with respect to the longitudinal direction so that the contact portion moves against an urging force of the urging portion upon the start of rotation.

4 Claims, 14 Drawing Sheets

| FIXING BELT 105 POSITION | +3.0mm | +1.5mm | | −1.5mm | −3.0mm |
|---|---|---|---|---|---|
| | REAR | | (F→R) (R→F) | FRONT | |
| | STOP | CHANGE POSITION | | CHANGE POSITION | STOP |
| 1ST SENSOR 150a | OFF | ON | ON | OFF | OFF |
| 2ND SENSOR 150b | OFF | OFF | ON | ON | OFF |
| STEPPING ROLLER RTTNL DRCTN | – | CW | – | CCW | – |
| STEERING ROLLER ANGLE | -2° | -2° | – | +2° | +2° |
| STATE | S1 | S2 | S3 | S4 | S5 |

Fig. 13

FIXING DEVICE THAT CONTROLS A POSITION OF A FIXING BELT USING A DISPLACING DEVICE

This application is a continuation of International Patent Application No. PCT/JP2017/020530, filed May 26, 2017, which claims the benefit of Japanese Patent Application No. 2016-105026, filed on May 26, 2016, both of which are hereby incorporated by reference herein in their entireties.

TECHNICAL FIELD

The present invention relates to a fixing device for fixing a toner image on a recording material. This fixing device is usable in an image forming apparatus, such as a copying machine, a printer, a facsimile machine, and a multi-function machine, or the like, having a plurality of functions of these machines.

BACKGROUND ART

Conventionally, in the image forming apparatus, an unfixed toner image is formed on a recording material, and thereafter, is subjected to a fixing process by a fixing device.

In a fixing device described in Japanese Laid-Open Patent Application No. 2015-59964, at least one of a pair of rotatable members for forming a nip (portion) is constituted by an endless belt.

Further, in this fixing device, a type in which a shift phenomenon of the endless belt is actively controlled is employed. Specifically, a position of the endless belt with respect to a widthwise direction is detected, and, on the basis of this position detection result, one of the rollers stretching the endless belt is inclined (i.e., tilted or swung), whereby the endless belt is reciprocated with a certain range.

When a wax component contained in toner adheres (sticks) to a mechanism for detecting the position of the endless belt, however, a normal position detection is not carried out, so that there is a liability that a situation such that the position of the endless belt cannot be properly controlled arises.

SUMMARY OF THE INVENTION

According to one aspect, the present invention provides a fixing device comprising a pair of rotatable members forming a nip for fixing a toner image on a recording material, wherein at least one of the rotatable members is an endless belt, a roller for rotatably supporting the endless belt, a detecting device including a contact portion contacting one end of the endless belt with respect to a widthwise direction, an urging portion for urging the contact portion toward the one end of the endless belt with respect to the widthwise direction, and a sensor for detecting a position of the contact portion, wherein the detecting device detects a position of the endless belt with respect to the widthwise direction depending on an output of the sensor, and a displacing device for displacing one end of the roller with respect to a longitudinal direction depending on the position of the endless belt detected by the detecting device, wherein, before rotation of the endless belt is started, the displacing device places the one end of the roller with respect to the longitudinal direction so that the contact portion moves against an urging force of the urging portion upon the start.

BRIEF DESCRIPTION OF THE DRAWINGS

Part (a) of FIG. 1 is a flowchart of belt shift control in Embodiment 1, and part (b) of FIG. 1 is a block diagram of a control system.

Figure 8:
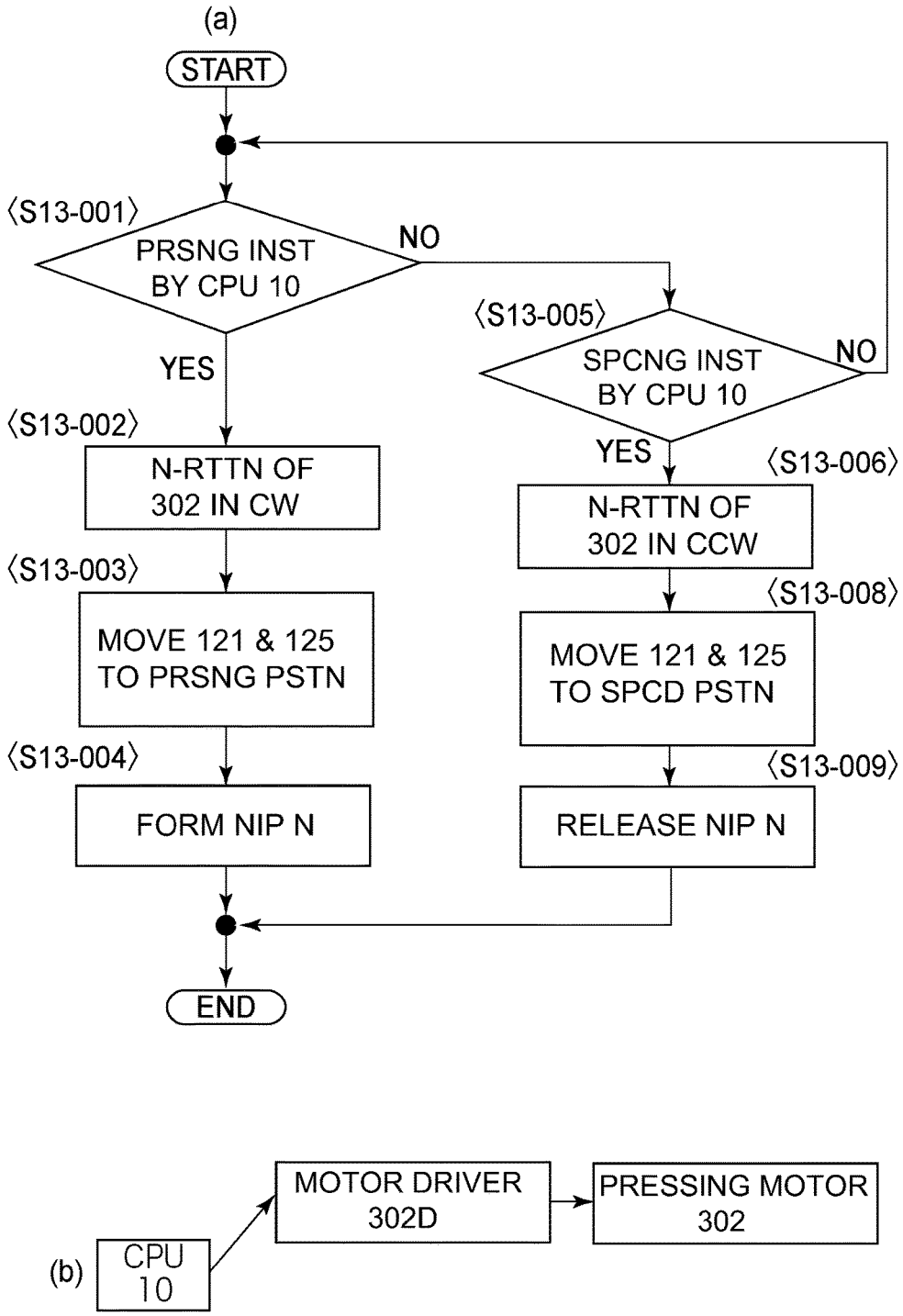

Part (a) of FIG. 8 is a flowchart of up-down movement control of a lower side belt assembly, and part (b) of FIG. 8 is a block diagram of a control system.

Figure 9:
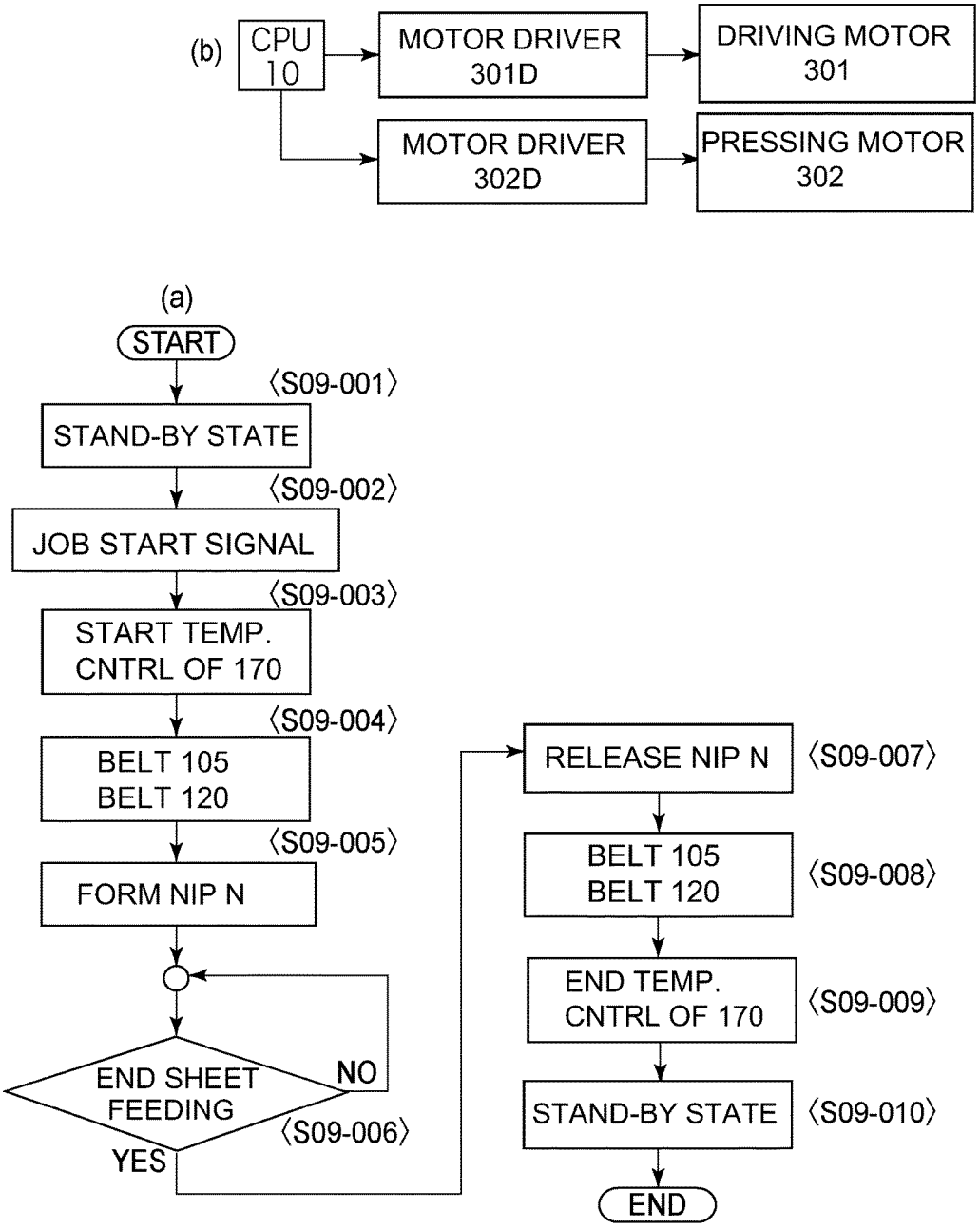

Part (a) of FIG. 9 is a fixing operation control flowchart, and part (b) of FIG. 9 is a block diagram of a control system.

Figure 10:
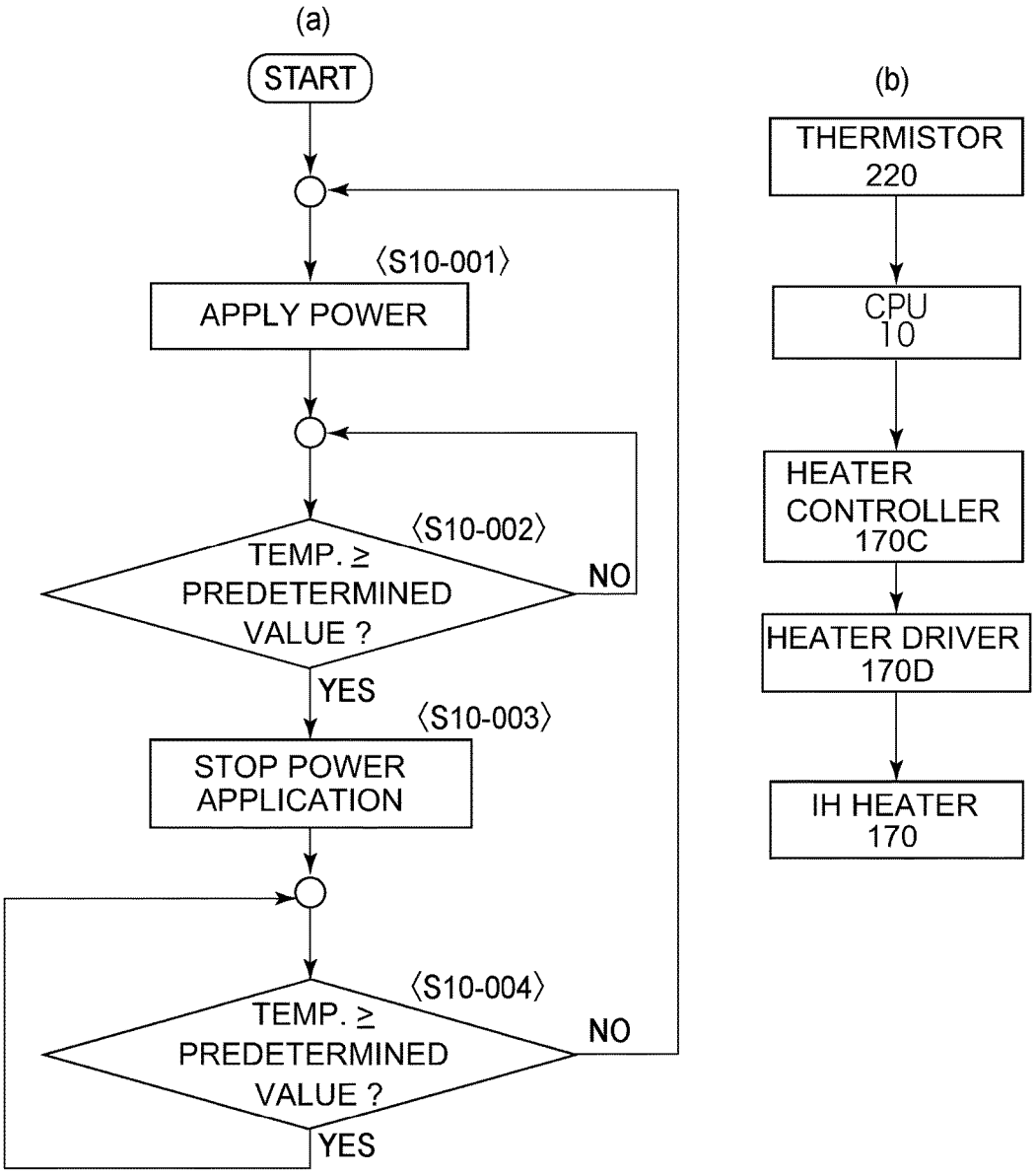

Part (a) of FIG. 10 is a fixing belt temperature control flowchart, and part (b) of FIG. 10 is a block diagram of a control system.

Figure 11:
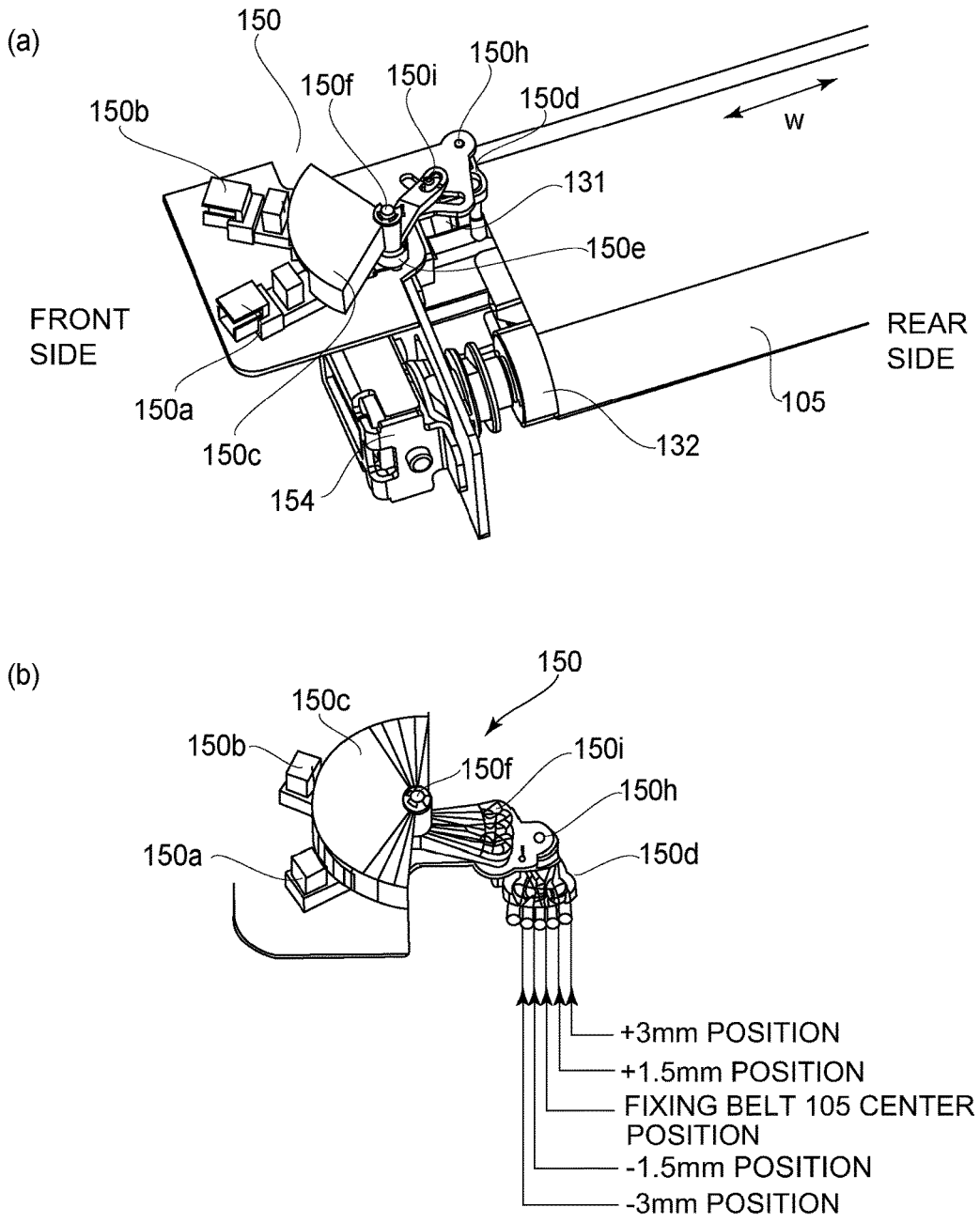

Part (a) of FIG. 11 is an illustration of a sensor portion for detecting a fixing belt end portion position, and part (b) of FIG. 11 is a view showing a combination of ON/OFF signals of first and second sensors and a positional relationship at that time.

Figure 12:
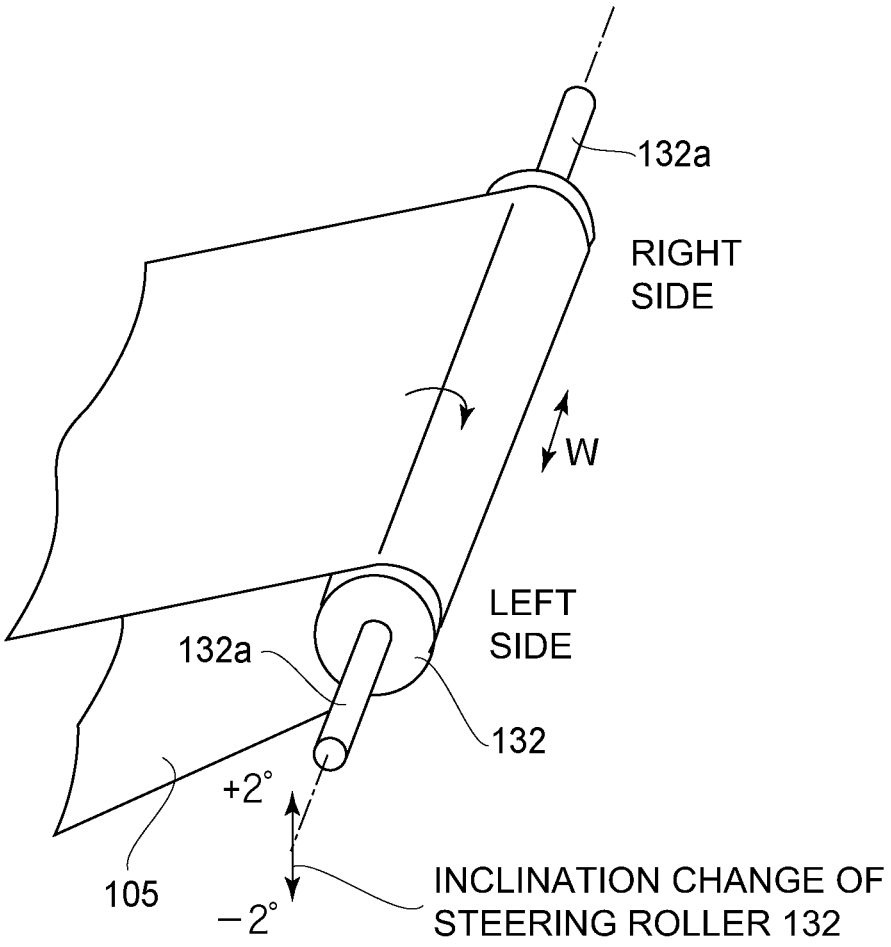

FIG. 12 is an illustration of inclination control of a steering roller.

FIG. 13 is a diagram for illustrating belt end portion positions and a flag logic.

Figure 14:
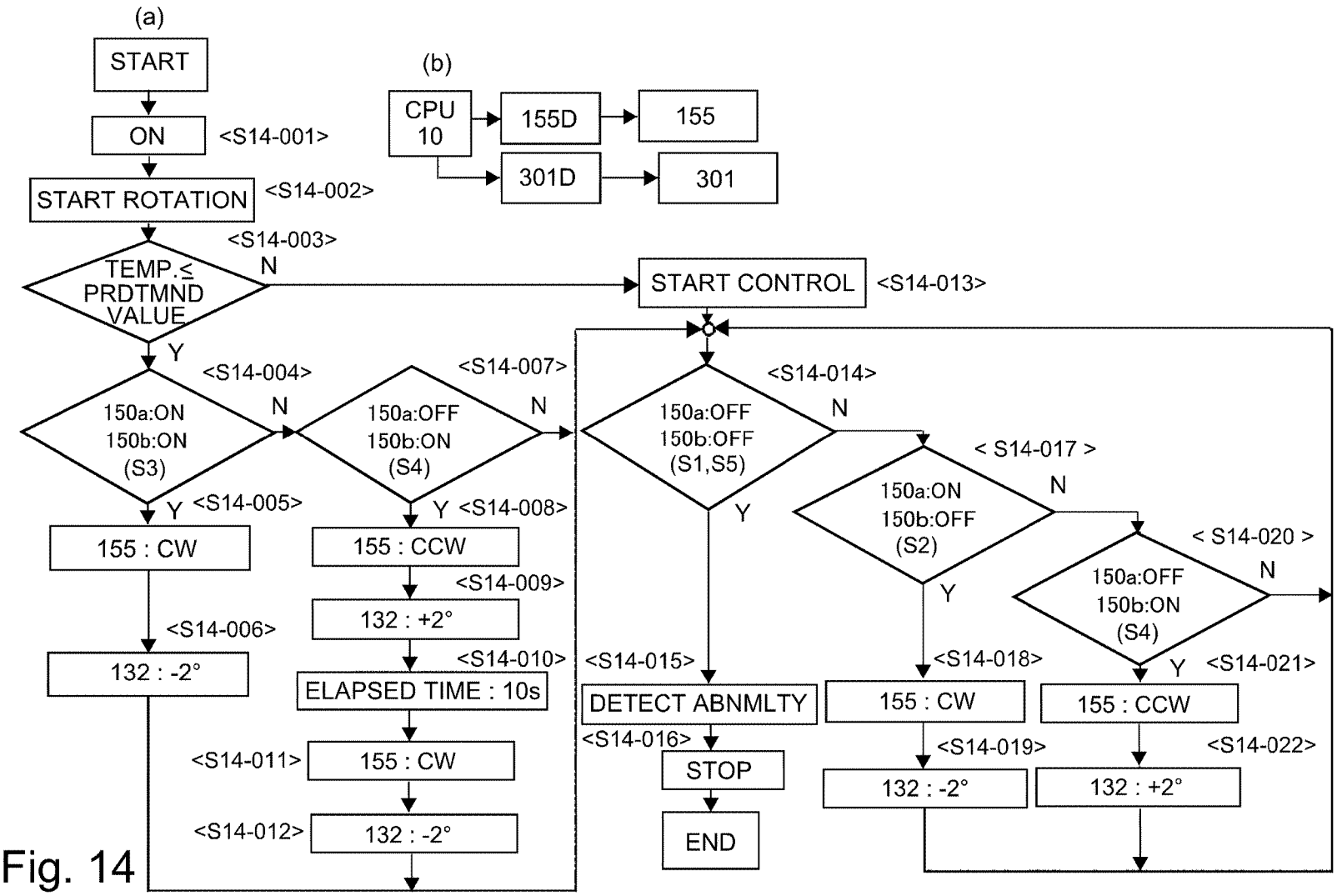

Part (a) of FIG. 14 is a flowchart of belt shift control in Embodiment 2, and part (b) of FIG. 14 is a block diagram of a control system.

EMBODIMENTS FOR CARRYING OUT THE INVENTION

Embodiment 1

(1) Image Forming Apparatus

Figure 2:
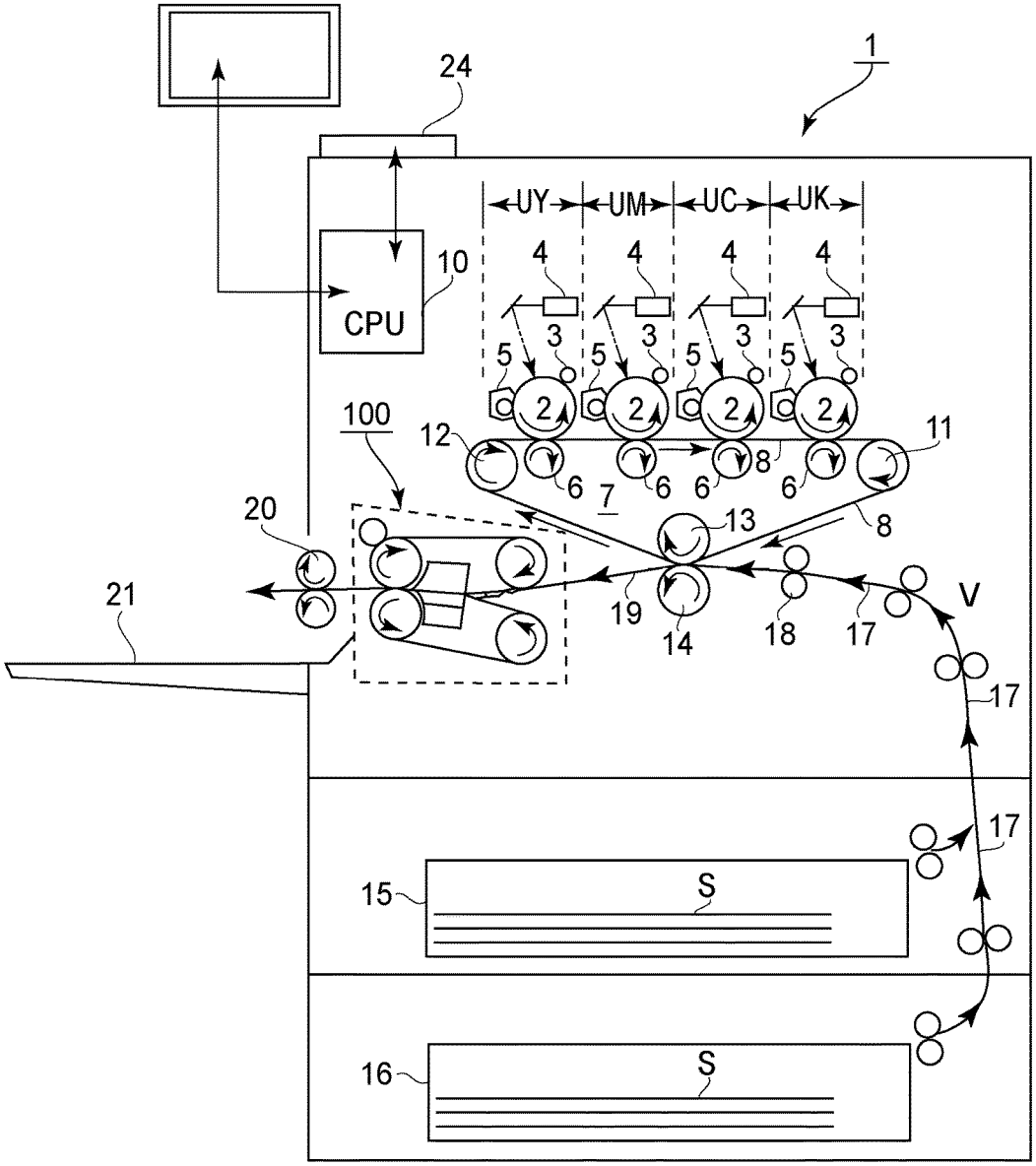
FIG. 2 is a sectional view for illustrating an image forming apparatus in Embodiment 1.

FIG. 2 is a schematic structural view of an image forming apparatus 1 in this embodiment and is a schematic sectional view along a feeding direction V of a recording material (i.e., a sheet) S. This image forming apparatus 1 is a four color-based, or full-color, electrophotographic printer (hereafter referred to as a printer) of an intermediary transfer in-line type.

Inside the printer 1, as shown in FIG. 2, first to fourth (four) image forming portions U (UY, UM, UC, UK) are juxtaposed from a left side to a right side. Each of respective image forming portions U is the same electrophotographic image forming mechanism, and is the same in constitution only except that the colors of toners as developers accommodated in developing devices 5 are yellow (Y), magenta (M), cyan (C), and black (K), which are different from each other. Each toner contains a wax component as a parting agent.

That is, each of the image forming portions U includes, as a first image bearing member, an electrophotographic photosensitive drum 2 (hereafter referred to as a drum) and includes, as process means actable on the drum 2, a charging roller 3, a laser scanner 4, a developing device 5, a primary transfer roller 6, and the like.

The drum 2 of each image forming portion U is rotationally driven in the counterclockwise direction indicated by an arrow at a predetermined speed. Then, on the drum 2 of the first image forming portion UY, a toner image of yellow (Y), corresponding to a yellow component image for a full-color image to be formed, is formed. On the drum 2 of the second image forming portion UM, a toner image of magenta (M), corresponding to a magenta component image, is formed. Further, on the drum 2 of the third image forming portion UC, a toner image of cyan (C), corresponding to a cyan component image, is formed. On the drum 2 of the fourth image forming portion UK, a toner image of black (K), corresponding to a black component image, is formed. Toner image forming processes performed on the drums 2 of the respective image forming portions U are well known and, therefore, will be omitted from description.

On a lower side of the respective image forming portions U, an intermediary transfer belt unit 7 is provided. This unit 7 includes a flexible endless intermediary transfer belt 8 as a second image bearing member. The belt 8 is extended and stretched among three rollers consisting of a driving roller 11, a tension roller 12, and a secondary transfer opposite roller 13. The belt 8 is circulated and moved in the clockwise direction, indicated by an arrow, at a speed corresponding to the rotational speed of the drums 2 by driving the driving roller 11. The secondary transfer opposite roller 13 is contacted to the belt 8 toward a secondary transfer roller 14 at predetermined pressure (urging force). A contact portion between the belt 8 and the secondary transfer roller 14 is a secondary transfer nip.

The primary transfer rollers 6 of the image forming portions U are provided inside the belt 8 and are contacted to the belt 8 toward lower surfaces of the drums 2. At each image forming portion U, a contact portion between the drum 2 and the belt 8 is a primary transfer nip. To the primary transfer roller 6, a predetermined primary transfer bias is applied at predetermined control timing.

The toner images of Y, M, C, and K, formed on the drums 2 of the image forming portion U, are successively primary-transferred superposedly at the primary transfer portions onto the surface of the belt 8, which is circulated and moved. As a result, an unfixed full-color toner image, including the superposed four color toner images, is synthetically formed on the belt 8 and is conveyed to the secondary transfer nip.

On the other hand, sheets S, accommodated in a first sheet cassette 15 or a second sheet cassette 16, are separated one by one by an operation of a feeding mechanism, and then, the separated sheet S is passed through a feeding path 17 to be sent to a registration roller pair 18. The registration roller pair 18 simultaneously receives and stops the sheet S, and corrects, in a case in which the sheet S is obliquely moved, the sheet S to a straight movement state. Then, the registration roller pair 18 feeds the sheet S to the secondary transfer nip in synchronism with the toner image on the belt 8.

In a period in which the sheet S is nipped and fed at the secondary transfer nip, to the secondary transfer roller 14, a predetermined secondary transfer bias is applied. As a result, the full-color toner image is collectively secondary-transferred from the belt 8 onto the sheet S. Then, the sheet S coming out of the secondary transfer nip is separated from the surface of the belt 8 and is passed through a feeding path 19 to be guided into a fixing device 100. The sheet S is heated and pressed in the fixing device 100, so that the unfixed toner image on the sheet is fixed as a fixed image. The sheet S coming out of the fixing device 100 is fed and discharged, as a full-color image-formed product, onto a discharge tray 21 by a discharging roller pair 20.

(2) Fixing Device 100

Figure 3:
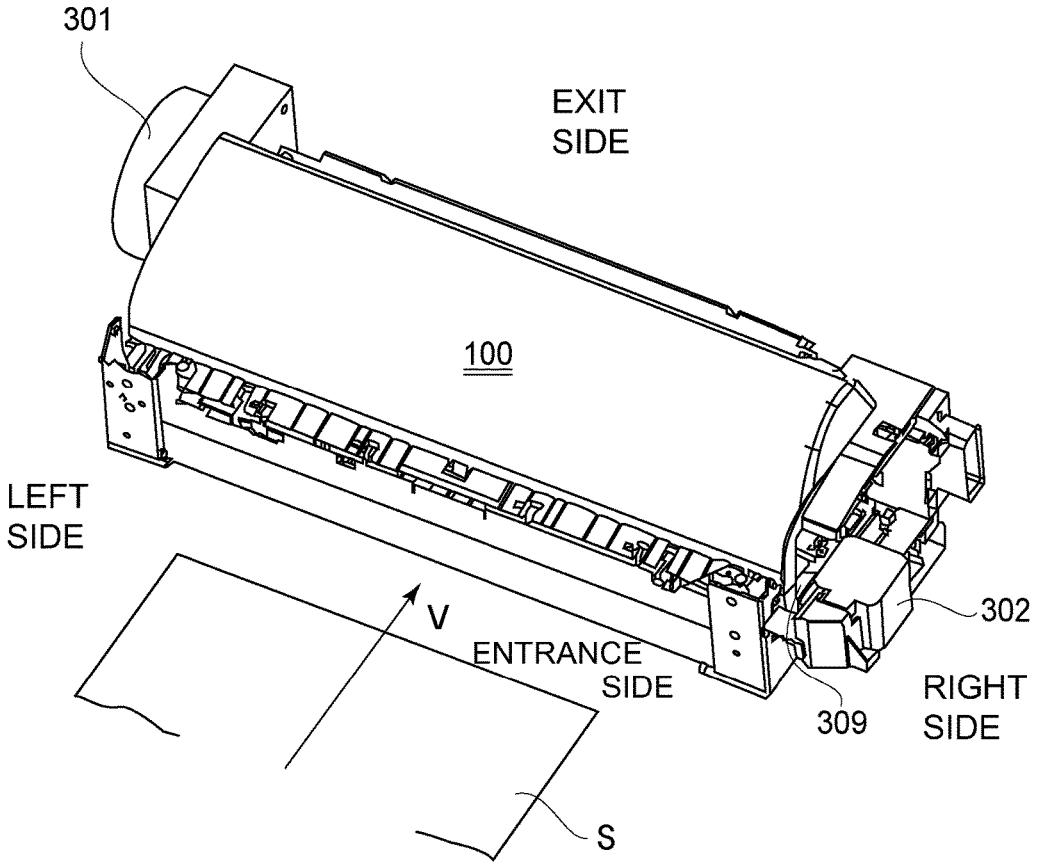
FIG. 3 is a perspective view of an outer appearance of a fixing device in Embodiment 1.
Figure 4:
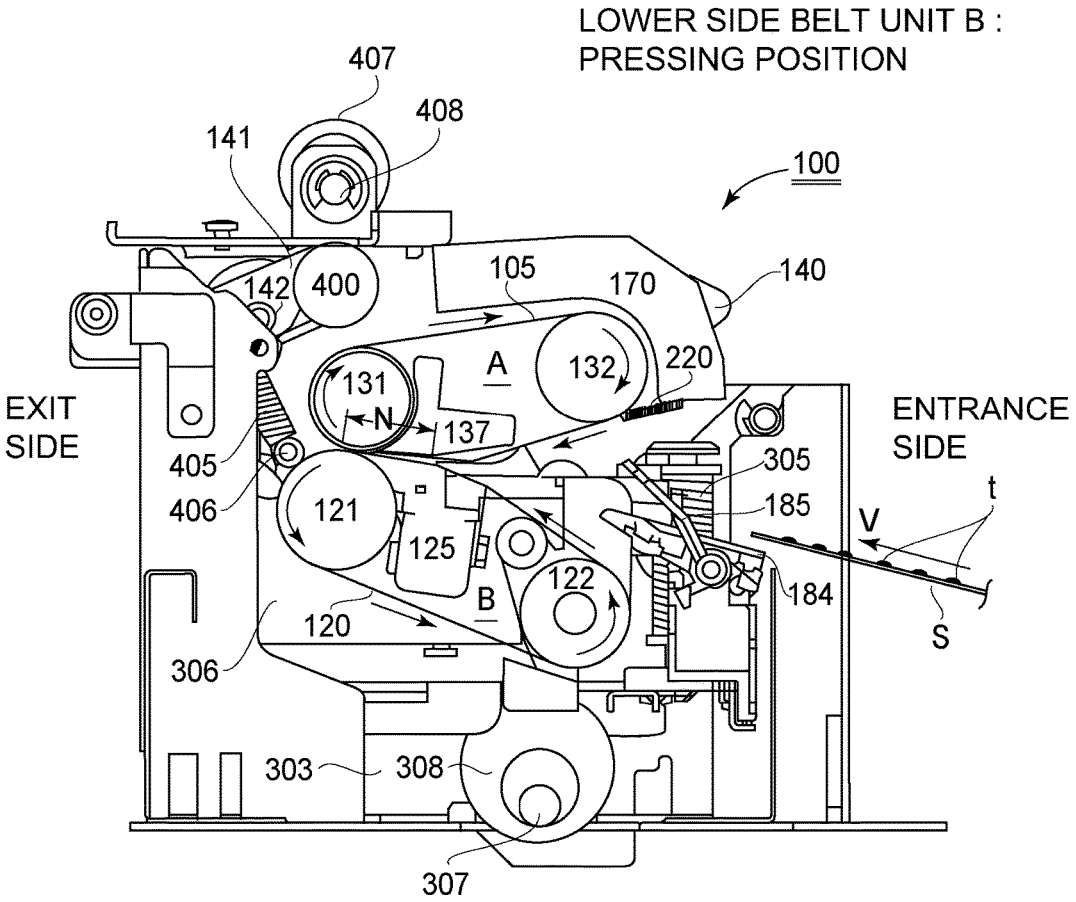
FIG. 4 is a sectional view (during a pressing state) of the fixing device.
Figure 5:
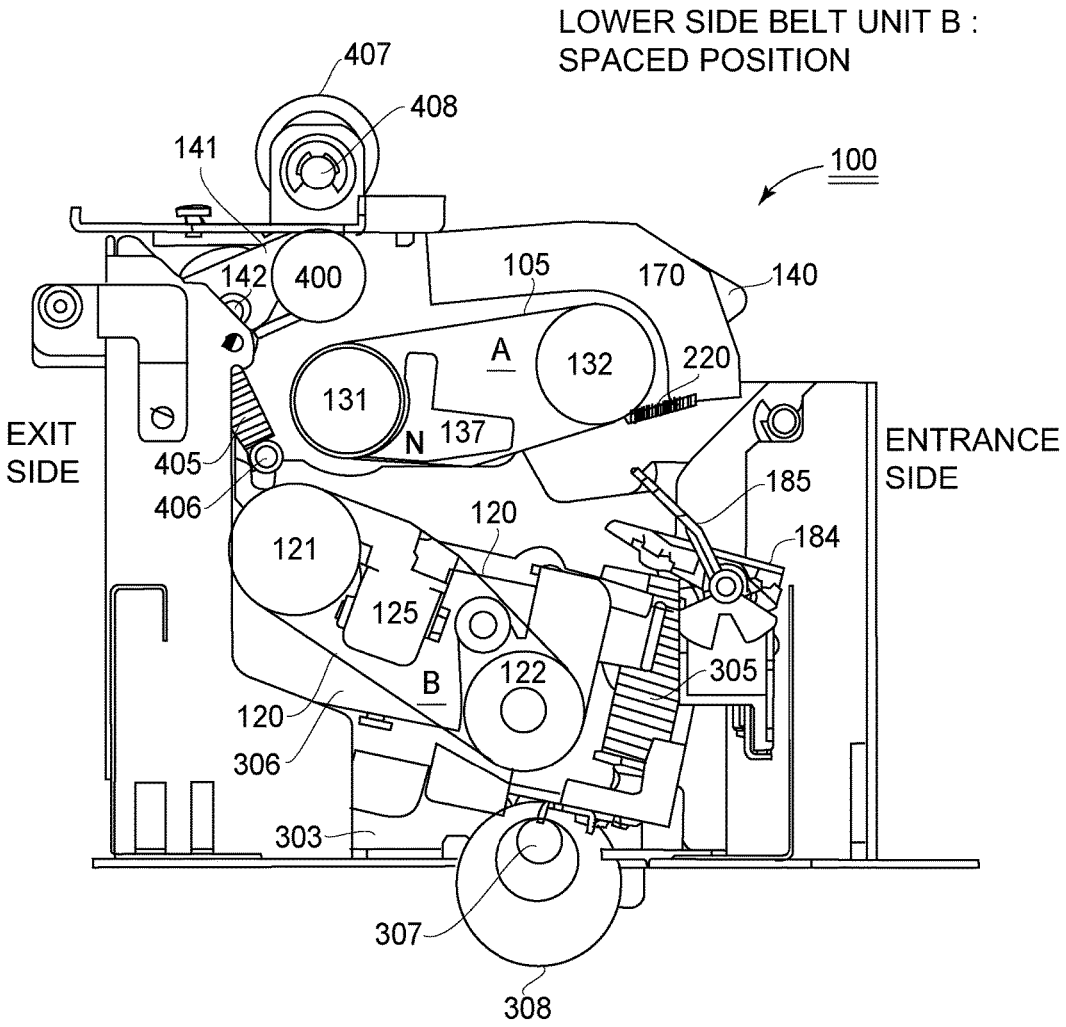
FIG. 5 is a sectional view (during a spaced state) of the fixing device.
Figure 6:
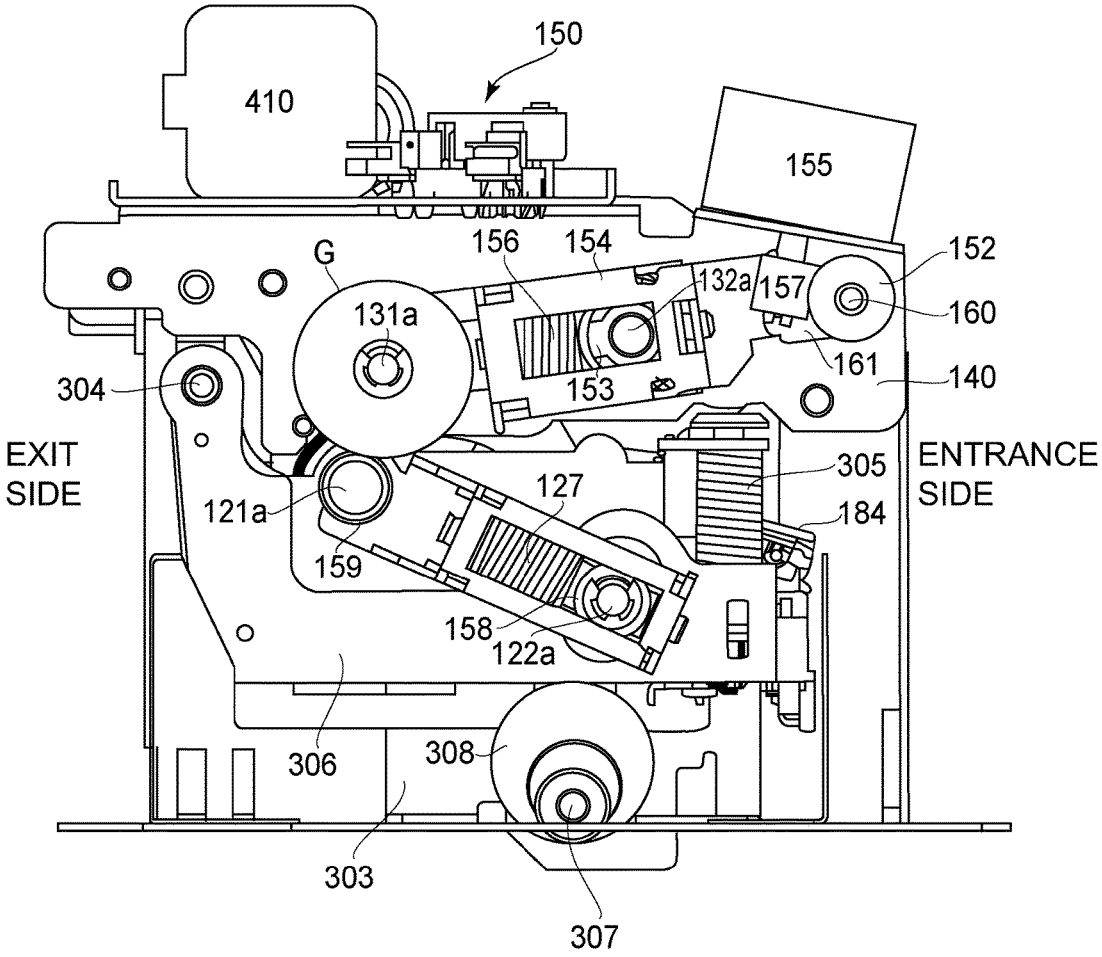
FIG. 6 is a left side view of the fixing device.
Figure 7:
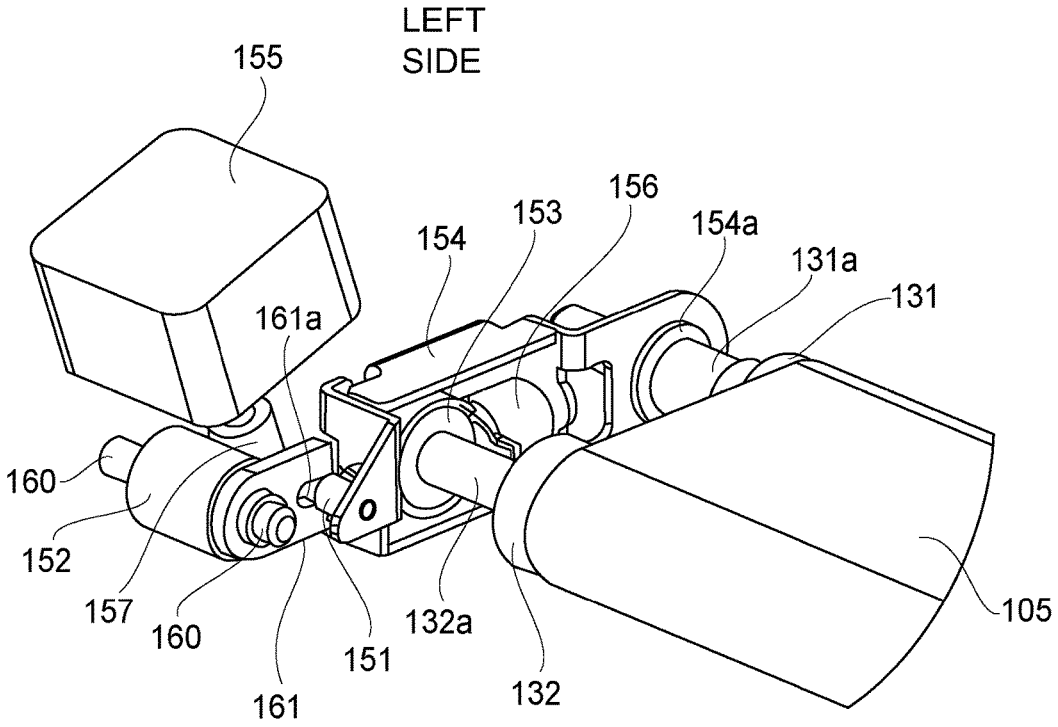
FIG. 7 is a view for illustrating a steering roller inclination control mechanism.

FIG. 3 is a perspective view of an outer appearance of the fixing device 100 in this embodiment. FIG. 4 is a cross-sectional left side view of a principal portion of the fixing device 100, and shows an urged state of a lower-side belt assembly B. FIG. 5 is a cross-sectional right side view of a principal part of the fixing device 100, and shows a pressure-eliminated state of the lower-side belt assembly B. FIG. 6 is a left side view of the principal part of the fixing device 100, and shows a pressed state of the lower-side belt assembly B. FIG. 7 is a perspective view of a belt shift control mechanism portion.

Here, with respect to the fixing device 100 or members constituting the fixing device 100, a longitudinal direction (longitudinal) or a widthwise direction (width) is a direction (or a dimension in the direction) parallel to a direction perpendicular to a feeding direction V of the sheet S in a sheet feeding path plane. A short direction (short) is a direction (or a dimension in the direction) parallel to the sheet feeding direction V in the sheet feeding path plane.

Further, with respect to the fixing device 100, a front surface (side) is a surface on a sheet entrance side, and a rear surface (side) is a surface on a sheet exit side, and left or right are left or right when the device is viewed from the front surface. In this embodiment, as shown in FIGS. 4 to 6, the right side of the drawing is a front side, and the left side of the drawing is a rear side. An upper side (up) and a lower side (down) are those with respect to the direction of gravitation. An upstream side and a downstream side are those with respect to the sheet feeding direction V. A width of the belt or the sheet is a dimension with respect to a direction perpendicular to the sheet feeding direction.

The fixing device 100 in this embodiment is an image heating apparatus of a twin belt nip type, an electromagnetic induction heating (IH) type, and an oil-less fixing type. This fixing device 100 includes an upper-side belt assembly A as a heating unit, and the lower-side belt assembly B as a pressing unit. Further, the fixing device 100 includes a pressing-spacing mechanism (contact-and-separation mechanism) for the lower-side belt assembly B relative to the upper-side belt assembly A. Further, the fixing device 100 includes an IH heater (magnetic flux generating means) 170, which is a heating means for heating a fixing belt 105 in the upper-side belt assembly A, a shift control mechanism for the fixing belt 105, and the like. In the following, these members will be sequentially described.

(2-1) Upper-Side Belt Assembly A and IH Heater 170

The upper-side belt assembly A is provided between left and right upper-side plates 140 of a device casing. This assembly A includes a parting layer at its surface, and a flexible endless fixing belt (endless belt-shaped fixing member, or endless belt) 105 as a first rotatable member (rotatable fixing member). Further, the assembly A includes, as a plurality of stretching members for stretching the fixing belt 105, a driving roller (rotatable driving member, or fixing roller) 131, a steering roller (rotatable steering member) 132 also functioning as a tension roller, and a pad stay 137.

The driving roller 131 is provided between the left and right upper-side plates 140 on the sheet exit side, and left and right shaft portions 131*a* are rotatably supported between the left and right upper-side plates 140 via bearings (not shown).

On each of the outsides of the left and right upper-side plates 140, a steering roller supporting arm 154 is provided and extends from the driving roller 131 side to the sheet entrance side. The right-side supporting arm 154 (not shown) is fixed to the upper-side plate 140 (not shown). Referring to FIG. 7, the left-side supporting arm 154 is supported by the left-side shaft 131*a* of the driving roller 131 via a bearing 154*a* and is swingable about the shaft 131*a* in an up-down direction. At a free end portion of the left-side supporting arm 154, a pin 151 is provided. At an outer surface of the upper-side plate 140, a shaft 160 is provided on the sheet entrance side.

By this shaft 160, a worm wheel (helical gear) 152, provided integrally with a fork plate 161 having a U-shaped groove portion 161*a*, is rotatably supported. The pin 151 of the left-side supporting arm 154 engages with the groove portion 161*a* of the fork plate 161. The upper-side plate 140 is provided with a stepping motor 155. A worm 157, fixed on a rotation shaft of this motor 155, engages with the worm wheel 152.

By normally driving or reversely driving the stepping motor 155, the fork plate 161 is rotationally moved in an upward direction or a downward direction via the worm 157 and the worm wheel 152. In interrelation with this, the left-side arm 154 is rotationally moved about the shaft 131*a* in the upward direction or the downward direction.

The steering roller 132 is provided in the sheet entrance side between the left and right upper-side plates 140, and left and right shaft portions 132*a* thereof are rotatably supported by the above-described left and right supporting arms 154, respectively, via bearings 153. The bearing 153 is supported slidably and movably in a belt tension direction relative to the supporting arm 154 and is moved and urged in a spacing direction from the driving roller 131 by a tension spring 156.

The pad stay 137 is a member formed of, e.g., stainless steel (SUS material). This pad stay 137 is fixed and supported between the left and right upper-side plates 140 at its left and right end portions so that the pad stay 137 is located inside the fixing belt 105 and closely to the driving roller 131 between the driving roller 131 and the steering roller 132 with a pad receiving surface facing downward.

The fixing belt 105, extended around the driving roller 131, the steering roller 132, and the pad stay 137, is under application of a predetermined tension (tensile force) by movement of the steering roller 132 in the belt tension direction by an urging force of the tension spring 156. In this embodiment, a tension force of 200 N is applied. A lower-side belt portion of the fixing belt 105 is contacted at its inner surface to the downward pad receiving surface of the pad stay 137.

As the fixing belt 105, any belt may be appropriately selected so long as the belt can be heated by the IH heater 170 and has heat resistance. For example, a belt prepared by coating a 300 μm-thick silicone rubber on a magnetic metal layer, such as a nickel layer or a stainless steel layer, of 75 μm in thickness, 380 mm in width, and 200 mm in circumference, and then by coating a perfluoroalkoxy alkane (PFA) tube as a surface layer (parting layer) on the silicone rubber, is used as the fixing belt 105.

The driving roller 131 is, e.g., a roller formed by integrally molding a heat-resistant silicone rubber elastic layer on a surface layer of a solid metal core formed of stainless steel in outer diameter of 18 mm. The driving roller 131 is provided in the sheet exit side in a nip region of the fixing nip N formed between the fixing belt 105 and a pressing belt 120, as a second rotatable member described later, and its elastic layer is elastically distorted by a predetermined amount by press-contact of the pressing roller 121, described later.

In this embodiment, the driving roller 131 and the pressing roller 121 form a nip shape, formed by sandwiching the fixing belt and the pressing belt 121 therebetween, in a substantially straight shape. In order to control buckling of the sheet S due to a speed difference of the sheet S in the fixing nip N, however, it is also possible to form various crown shapes of the rollers in such a manner that the crown shapes of the driving roller 131 and the pressing roller 121 are intentionally formed as a reverse-crown shape, or the like.

The steering roller 132 is, e.g., a hollow roller formed of stainless steel so as to have an outer diameter of 20 mm and an inner diameter of about 18 mm. This steering roller 132 not only functions as a tension roller that stretches the fixing belt 105 to apply tension to the fixing belt 105, but also functions as a steering roller for adjusting meandering of the fixing belt 105 in the widthwise direction perpendicular to a movement direction of the fixing belt 105 by being controlled in inclination by a shift control mechanism (displacing means), described later.

To the driving roller 131, a drive input gear G is coaxially provided and is fixed on a left end side of the belt shaft 131*a*. To this gear G, drive input from a driving motor 301 (FIG. 3) is made via a drive transmission means (not shown), so that the driving roller 131 is rotationally driven in the clockwise direction, indicated by an arrow in FIG. 4, at a predetermined speed.

By the rotation of the driving roller 131, the fixing belt 105 is circulated and is fed in the clockwise direction, indicated by the arrow, at a speed corresponding to the speed of the driving roller 131. The steering roller 132 is rotated by the circulation feeding of the fixing belt 105. The inner surface of the lower-side belt portion of the fixing belt 105 slides and moves on the downward pad receiving surface of the pad stay 137. In order to stably feed the sheet S to the fixing nip N, described later, the drive (driving force) is transmitted with reliability between the fixing belt 105 and the driving roller 131.

The IH heater 170, as a heating means for heating the fixing belt 105, is an induction heating coil unit constituted by an exciting coil, a magnetic core, and a holder for holding these members, and the like. The IH heater 170 is disposed above the upper-side belt assembly A, and is fixed and disposed between the left and right upper-side plates 140 so that it extends from a portion of the upper surface of the fixing belt 105 to a portion of the steering roller 132 and opposes the fixing belt 105 in a non-contact manner with a predetermined gap therebetween.

The exciting coil of the IH heater 170 generates an alternating current (AC) magnetic flux by being supplied with an AC current, and the AC magnetic flux is guided by the magnetic core to generate an eddy current in the magnetic metal layer of the fixing belt 105 as an induction heat generating member. The eddy current generates Joule heat by specific resistance of the induction heat generating member. The AC current to be supplied to the exciting coil is controlled so that a surface temperature of the fixing belt 105 is temperature-controlled at about 140° C. to about 200° C. (target temperature) on the basis of temperature information from a thermistor 220 for detecting the surface temperature of the fixing belt 105.

(2-2) Lower-Side Belt Assembly B and Pressing-Spacing Mechanism

The lower-side belt assembly B is provided below the upper-side belt assembly A. This assembly B is assembled with a lower frame (urging frame) 306 rotatably supported in the vertical (up-down) direction about a hinge shaft 304 fixedly provided between left and right lower-side plates 303 in the sheet exit side in the fixing device 100.

This assembly B includes the fixing belt 105 provided on the upper-side assembly A and a flexible endless pressing belt 120 as a second rotatable member (rotatable pressing member) for forming the nip N with the fixing belt 105. Further, the assembly B includes, as a plurality of belt stretching members for stretching the pressing belt 120 with tension, a pressing roller (pressing roller) 121, a tension roller 122, and a pressing pad 125.

The pressing roller 121 is rotatably supported at left and right shaft portions 121*a* thereof between the left and right side plates of the lower frame 306 via bearings 159. The tension roller 122 is rotatably supported at left and right shaft portions 122*a* thereof by the left and right side plates of the lower frame 306 via bearings 158. The bearing 158 is supported slidably and movably in the belt tension direction relative to the lower frame 306 and is urged by a tension spring 127 so as to move in a spacing direction from the pressing roller 121.

The pressing pad 125 is a member formed with, e.g., a silicone rubber, and left and right end portions thereof are fixed and supported between the left and right side plates of the lower frame 306. The pressing roller 121 is located on the sheet exit side between the left and right side plates of the lower frame 306. The tension roller 122 is located on the sheet entrance side between the left and right side plates of the lower frame 306. The pressing pad 125 is non-rotationally supported and disposed so that the pad 125 is located inside the pressing belt 120 and closely to the pressing roller 121 between the pressing roller 121 and the tension roller 122 with a pad surface facing upward.

The pressing belt 120, extended around the pressing roller 121, the tension roller 122, and the pressing pad 125, is under application of a predetermined tension force by movement of the tension roller 122 in the belt tension direction by an urging force of the tension spring 127. In this embodiment, the tension force of 200 N is applied. An upper-side belt portion of the fixing belt 105 is contacted at its inner surface to the upward facing pad surface of the pressing pad 125.

As the pressing belt 120, any belt may be appropriately selected if the belt has heat resistance. For example, a belt prepared by coating a 300 μm-thick silicone rubber on a nickel layer of 50 μm in thickness, 380 mm in width, and 200 mm in circumference, and then by coating a PFA tube as a surface layer (parting layer) on the silicone rubber is used as the pressing belt 120. The pressing roller 121 is, e.g., a roller formed of a solid stainless steel in outer diameter of 20 mm. Further, the tension roller 122 is, e.g., a hollow roller formed of stainless steel so as to have an outer diameter of 20 mm and an inner diameter of about 18 mm.

The lower-side belt assembly B is rotation-controlled about the hinge shaft 304 in the up-down direction by the pressing-spacing mechanism as a contact-and-separation means. That is, the lower-side belt assembly B is raised and rotationally moved by the pressing-spacing mechanism and thus, is moved to a pressing position, as shown in FIG. 4. Further, the lower-side belt assembly B is moved to a spaced position, as shown in FIG. 5, by being lowered and rotationally moved.

The assembly B is moved to the pressing position, so that the pressing roller 121 and the pressing pad 125 are press-contacted to the pressing belt 120 toward the driving roller 131 and the pad stay 137 of the upper-side belt assembly A via the fixing belt 105. As a result, between the fixing belt 105 of the upper-side belt assembly A and the pressing belt 120 of the lower-side belt assembly B, the fixing nip N, having a predetermined width with respect to the feeding direction V of the sheet S, is formed. Further, the lower-side belt assembly B is moved to the spaced position, so that the pressing thereof against the upper-side belt assembly A is eliminated and the lower-side belt assembly B is spaced in a non-contact state.

The above-described pressing-spacing mechanism in this embodiment will be described. A lower frame 306 is provided on an opposite to the hinge shaft 304 side, with a pressing spring 305 for causing the lower-side belt assembly B to elastically press-contact the upper-side belt assembly A.

At a lower portion between the left and right lower-side plates 303, a pressing cam shaft 307 is rotatably shaft-supported and disposed. On left and right sides of this pressing cam shaft 307, a pair of eccentric pressing cams 308, having the same shape and the same phase, for supporting a lower surface of the lower frame 306, are provided. On a right end side of the pressing cam shaft 307, a pressing gear 309 (FIG. 3) is coaxially fixed and disposed. To this gear 309, drive input is made from the pressing motor 302 via a drive transmitting means (not shown), so that the pressing cam shaft 307 is rotationally driven.

The pressing cam shaft 307 is rotation-controlled to a first angular position of rotation in which a largely protruded portion of the eccentric pressing cam 308 is directed upward, as shown in FIGS. 4 and 6, and to a second angular position of rotation in which the largely protruded portion is directed downward, as shown in FIG. 5.

The pressing cam shaft 307 is rotated to the first angular position of rotation and is stopped, so that the lower frame 306 on which the lower-side belt assembly B is mounted is raised by the largely protruded portion of the eccentric pressing cam 308. Then, the lower-side belt assembly B contacts the upper-side belt assembly A while compressing the pressing spring 305 of the pressing spring unit. As a result, the lower-side belt assembly B is pressed and urged elastically against the upper-side belt assembly A at a predetermined pressure (e.g., 400 N) by a compression reaction force of the pressing spring 305, and is held at the pressing position.

Here, by the press-contact of the pressing roller 121 to the pressing belt 120 toward the driving roller 131, curvature deformation of about several hundreds of microns is generated on the driving roller 131 in a side opposite from the side on which the driving roller 131 opposes the pressing roller 121. This curvature deformation of the driving roller 131 constitutes a factor of depressurization at a longitudinal central portion of the fixing nip N. In order to eliminate this depressurization, the driving roller 131, or both of the driving roller 131 and the pressing roller 121 are formed in a crown shape, so that a nip shape provided by the driving roller 131 and the pressing roller 121 is made substantially straight. In this embodiment, the driving roller 131 is formed in a normal crown shape of 300 μm.

Further, the pressing cam shaft 307 is rotated to the second angular position of rotation and is stopped, so that the largely protruded portion of the eccentric pressing cam 308 is directed downward and a small protruded portion corresponds to the lower surface of the lower frame 306 to lower the lower-side belt assembly B. That is, the pressure of the lower-side belt assembly B to the upper-side belt assembly A is eliminated and is held at the spaced position from the upper-side belt assembly A in a non-contact and predetermined spaced manner, as shown in FIG. 5.

With reference to the control flowchart of part (a) of FIG. 8 and the block diagram of a control system of part (b) of FIG. 8, vertical movement control of the lower-side belt assembly B will be described.

The lower-side belt assembly B is usually held at the spaced position, shown in FIG. 5. By a pressing instruction from a central processing unit (CPU) 10 (S13-001), the pressing motor 302 rotates in clockwise direction by N turns, which is a predetermined number of rotations, via the motor driver 302D (S13-002), so that the pressing cam shaft 307 is driven a half turn. As a result, the eccentric pressing cam 308 is changed in angular position from the second angular position of rotation of FIG. 5 to the first angular position of rotation of FIGS. 4 and 6, so that the lower-side belt assembly B is raised and rotationally moved, and the pressing roller 121 and the pressing pad 125 move to the pressing position (S13-003).

That is, the pressing roller 121 and the pressing pad 125 press-contact the pressing belt 120 toward the driving roller 131 and the pad stay 137 of the upper-side belt assembly A via the fixing belt 105 at a predetermined contact pressure. As a result, between the fixing belt 105 and the pressing belt 120, the fixing nip N having a predetermined width with respect to the sheet feeding direction V is formed (S13-004).

Further, in a state in which the lower-side belt assembly B is usually held at the spaced position, shown in FIG. 5, by a pressing instruction from the CPU 10 (S13-005), the pressing motor 302 rotates in counter-clockwise direction by N turns, which is a predetermined number of rotations, via the motor driver 302D (S13-006). As a result, the pressing cam shaft 307 is driven a half turn, so that the eccentric pressing cam 308 is changed in angular position from the first angular position of rotation of FIGS. 4 and 6 to the second angular position of rotation of FIG. 5. That is, the lower-side belt assembly B is raised and rotationally moved, so that the pressing roller 121 and the pressing pad 125 move to the spaced position (S13-008). As a result, the formation of the fixing nip N is eliminated (S13-009).

(2-3) Fixing Operation and Temperature Control

A fixing operation of the fixing device 100 will be described with reference to the control flow chart of part (a) of FIG. 9 and the block diagram of a control system of part (b) of FIG. 9. During a waiting state (stand-by state) of the fixing device 100 (S09-001), the lower-side belt assembly B is held at the spaced position of FIG. 5, and the drive of the driving motor 301 is stopped driven at a predetermined stand-by speed. Electrical energy supply to the IH heater 170 is also controlled so as to provide a predetermined stand-by temperature.

The CPU 10 starts predetermined image forming sequence control on the basis of input of a print job start signal (S09-002). With respect to the fixing device, electrical power is supplied from the CPU 10 to the IH heater 170 via a heater controller 170C (part (b) of FIG. 10) and a heater driver 170D. Then, the rotating fixing belt 105 is subjected to electromagnetic induction heating, so that temperature control of raising a fixing belt temperature up to a target temperature is started. That is, the temperature control such that the temperature of the fixing belt 105 is raised from the stand-by temperature to the target temperature (about 160° C. in this embodiment) depending on a basis weight and a kind (paper kind) of the fed sheet S, is performed (S09-003).

When the temperature of the fixing belt 105 reaches the target temperature, the CPU 10 drives the driving motor 301 via a motor driver 301D and inputs drive to a drive input gear G. By this arrangement, the driving roller 131 of the upper side belt assembly A is driven as described above, so that the fixing belt 105 is accelerated to a predetermined speed.

Further, a rotational force of the drive input gear G is also transmitted to the pressing roller 121 of the lower side belt assembly B via a drive gear train (not shown), so that acceleration of the pressing roller 120 is also started (S09-004).

Then, the pressing motor 302 is driven via a motor driver 302D, and the pressing cam shaft 307 is driven a half turn, so that the lower-side belt assembly B is moved from the spaced position of FIG. 5 to the pressing position of FIG. 4. As a result, the fixing nip N is formed between the fixing belt 105 and the pressing belt 120 (S09-005).

Then, in a state in which the temperature control of the fixing belt 105, the acceleration of the fixing belt 105 and the pressing belt 120, and the formation of the fixing nip N are effected, the sheet S, on which surface the unfixed toner image t (FIG. 4) is formed, is guided from the image forming station into the fixing device 100. The sheet S is guided by an entrance guide 184 provided at a sheet entrance portion of the fixing device 100 to enter the fixing nip N, which is the press-contact portion between the fixing belt 105 and the pressing belt 120.

The sheet S opposes the fixing belt 105 at its image-carrying surface and opposes the pressing belt 120 at its surface opposite from the image-carrying surface, and, in this state, the sheet S is nipped and fed at the fixing nip N. Then, the unfixed toner image t is fixed, as a fixed image, on the sheet surface by heat of the fixing belt 105 and the nip pressure. The sheet S, having passed through the fixing nip N, is separated from the surface of the fixing belt 105 and comes out of the fixing device 100 from the sheet exit side, and then is fed and discharged onto a discharge tray 21 by a discharging roller pair 20 (FIG. 2).

Then, when the feeding of the sheet S in the print job of a predetermined single sheet or a plurality of successive sheets is ended (S09-006), the CPU 10 drives the pressing motor 302 via the motor driver 302D. Then, the pressing cam shaft 307 is driven a half turn, so that the lower-side belt assembly B is moved from the pressing position of FIG. 4 to the spaced position of FIG. 5. By this arrangement, the fixing nip N between the fixing belt 105 and the pressing belt 120 is released (eliminated) (S09-007).

Then, the driving motor 301 is decelerated, so that rotation of the fixing belt 105 and the pressing belt 120 is decelerated to the stand-by speed (S09-008). Then, the CPU 10 ends the heating and the temperature control of the fixing belt 105 and carries out electrical power control to the IH heater 170 so that the temperature of the fixing belt 105 is the stand-by temperature (S09-009). In this state, the CPU 10 carries out waiting of input of a subsequent print job start signal (S09-010).

With reference to the control flow chart of part (a) of FIG. 10 and the block diagram of a control system of part (b) of FIG. 10, temperature control of the fixing belt 105 will be described. In the upper-side belt assembly A, a thermistor 220, as a temperature detecting member for detecting the surface temperature of the fixing belt 105, is provided. The CPU 10 supplies the electrical power to the IH heater 170 via the heater controller 170C and the heater driver 170D on the basis of the state of the printer 1 (S10-001). The fixing belt 105 is increased in temperature through the electromagnetic induction heating by the IH heater 170.

The temperature of the fixing belt 105 is detected by the thermistor 220, and detection temperature information (electrical information on the temperature) is inputted into the CPU 10.

When the detection temperature by the thermistor 220 is not less than a predetermined value (standby temperature, target temperature) (S10-002), the CPU 10 stops the supply of the electrical power to the IH heater 170 (S10-003). Thereafter, when the detection temperature by the thermistor 220 is less than the predetermined value (S10-004), the CPU 10 resume the supply of the electrical power to the IH heater 170 (S10-001).

By repetition of the above-described steps S10-001 to S10-004, the fixing belt 105 is temperature-controlled and kept at the predetermined target temperature. Then, the fixing belt temperature control, described above, is continued until the electrical power source of the printer 1 is turned off.

(2-4) Belt Shift Control Mechanism

The fixing belt 105 generates a phenomenon that, in a rotation process thereof, the fixing belt 105 moves so as to shift toward one side (one end portion side) or the other side (the other end portion side) with respect to a widthwise direction W (part (a) of FIG. 11, FIG. 12) perpendicular to the sheet feeding direction V (shift movement of the belt). Also the pressing belt 120, forming the fixing nip N in press-contact with the fixing belt 105, shifts and moves similarly as in the case of the fixing belt 105.

In this embodiment, this shift movement of the fixing belt 105 is stabilized within a predetermined shift range (within a predetermined zone) by swing-type shift control. The swing-type shift control is such a method that, in a case in which movement of a belt position from a widthwise central portion by a predetermined amount is detected, the steering roller 132 is inclined in an opposite direction to the shift movement direction of the fixing belt 132.

By repeating this swing-type shift control, the fixing belt 105 periodically moves from one side (one position of the widthwise direction) to the other side (the other direction of the widthwise direction) in the widthwise direction, and, therefore, the shift movement of the fixing belt 105 can be controlled stably. That is, the fixing belt 105 is constituted so as to be reciprocable in the direction W perpendicular to the feeding direction V of the sheet S.

In the upper-side belt assembly A, at a position toward the steering roller 132 on the left side (front side) of the fixing belt 105, a sensor portion 150 (part (a) of FIG. 11), which is a position detecting means for detecting a fixing belt end portion position, is provided. The CPU 10 detects the end portion position (belt shift movement position) of the fixing belt 105 by this sensor portion (detecting means) 150, and correspondingly thereto, changes a degree of inclination of the steering roller 132, so that the CPU 10 carries out the belt shift control during the belt rotation.

The CPU (displacing means) 10 detects the end portion position of the fixing belt 105 by this sensor portion 150, and correspondingly thereto, rotates the stepping motor 155 in the normal rotational direction (i.e., the clockwise direction) or the reverse rotational direction (i.e., the counter-clockwise direction) by a predetermined number of rotations. By this arrangement, via the above-described mechanisms 157, 152, 161, and 151 of FIGS. 6 and 7, the left-side steering roller supporting arm 154 rotationally moves about the shaft 131*a* upward or downward by a predetermined control amount. In interrelation with this movement, an inclination of the steering roller 132 changes (FIG. 12), so that the shift control of the fixing belt 105 is effected.

That is, the steering roller 132 is a steering means capable of moving the fixing belt 105 toward the one end portion side in the widthwise direction and capable of moving the fixing belt 105 toward the other end portion side in the widthwise direction. Depending on a detection result of the sensor portion 150, the CPU 10 controls the steering roller 132 so that the fixing belt 105 reciprocates in the predetermined zone with respect to the widthwise direction.

The sensor portion 150 includes a plurality of sensors (photo-interrupters) and a sensor flag 150*c* rotatable (swingable) in the normal rotational direction or the reverse rotational direction along first and second (two) sensors 150*a* and 150*b* and about a shaft 150*f* in this embodiment. By rotation of this sensor flag 150*c* in the normal rotational direction or the reverse rotational direction, the first and second sensors 150*a* and 150*b* are turned on and off with a predetermined relationship, respectively. Further, the sensor portion 150 includes a sensor arm 150*d* rotatable (swingable) in the normal rotational direction of the reverse rotational direction about the shaft 150*h*.

The sensor arm 150*d*, as a contact portion, is rotationally urged about the shaft 150*h* in a direction of contacting a right-side end surface of the fixing belt 105 by a sensor spring 150*e* as an urging portion. In this embodiment, the sensor arm 150*d* is always urged against and contacted to the right-side end surface of the fixing belt 105 with a force of 3 gf by the sensor spring 150*e*.

That is, the sensor arm 150*d* is a swingable member contacting the one end of the fixing belt 150 with respect to the widthwise direction, and is urged toward the other end portion side of the fixing belt 105 with respect to the widthwise direction by the sensor spring 150*e*. Accordingly, the sensor arm 150*d* performs a rotational operation about the shaft 150*h* in the normal rotational direction or the reverse rotational direction by following the shift movement of the fixing belt 105.

The sensor flag (rotational portion, interrelating portion) 150*c* and the sensor arm 150*d* are connected by an interrelating mechanism 150*i* constituted by a pin and an elongated hole. Accordingly, the sensor arm 150*d* rotates in the normal rotational direction or the reverse rotational direction by following the shift movement of the fixing belt 105, and in interrelation with this rotation of the sensor arm 150*d*, the sensor flag 150*c* rotates in the normal rotational direction or the reverse rotational direction. By this arrangement, the first and second sensors 150*a* and 150*b* are turned on and off with a predetermined relationship, respectively. The CPU 10 performs the shift position detection of the fixing belt 105 by a combination of ON/OFF signals of the first and second sensors 150*a* and 150*b*.

That is, the respective sensors 150*a* and 150*b* are provided in the neighborhood of the sensor flag 150*c*, and detect a rotational position (swing position) of the sensor flag 150*c*, so that the sensors 150*a* and 150*b* detect that the fixing belt 105 is in a position (reciprocating position) on one side or the other side in the predetermined zone.

Figure 1:
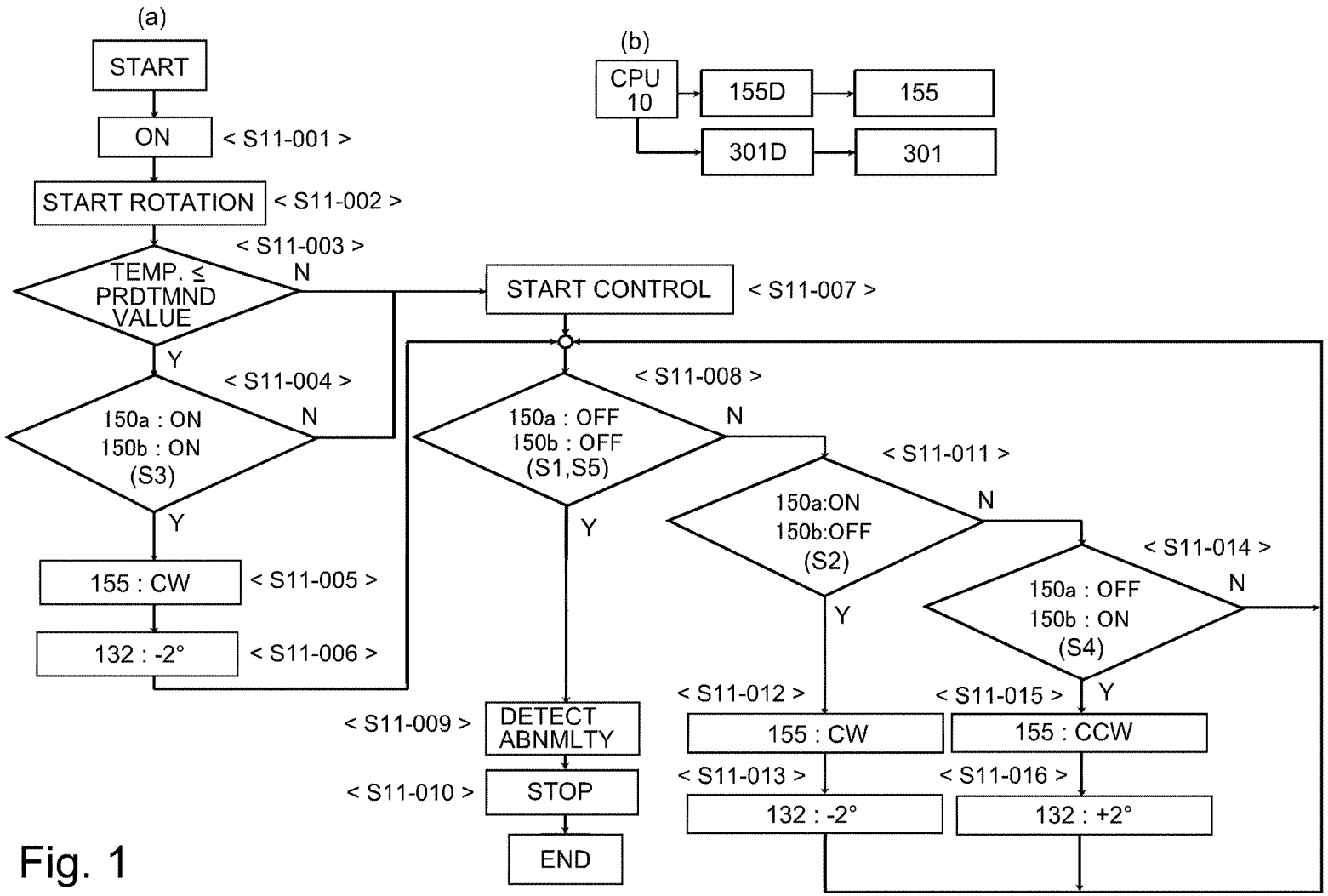

A combination of the ON/OFF signals of the first and second sensors 150*a* and 150*b* and a positional relationship at that time are shown in part (b) of FIG. 11, and a relationship of end surface positions of the fixing belt 105 at that time is shown in FIG. 13. Further, a control flowchart is shown in FIG. 1. Incidentally, a signal is turned off when the sensor flag 150*c* light-blocks the respective sensors 150*a* and 150*b*, and an ON signal is provided when the light passes through the sensor 150*a* or 150*b*. The left side of the fixing belt 105 is the front side, and the right side of the fixing belt 105 is the rear side.

First, when the power source of the printer 1 is turned on (S11-001), the CPU 10 starts rotation of the driving motor 301 via the motor driver 302D (S11-002). By this arrangement, the fixing belt 105 and the pressing belt 120 rotate.

Then, the CPU 10 checks the temperature of the fixing device 100 (S11-003). Here, when the temperature of the fixing device 100 is greater than a predetermined temperature, the CPU 10 starts the belt shift control (S11-007).

When the temperature of the fixing device 100 is not more than the predetermined temperature, the CPU 10 checks logic of the first sensor 150*a* and the second sensor 150*b* (S11-004). Incidentally, the predetermined temperature in this embodiment is 100° C.

Here, in a case in which the first sensor 150*a* is turned on and the second sensor 150*b* is turned on (state S3 of FIG.

13), the CPU 10 outputs a predetermined driving pulse toward the clockwise direction to the stepping motor 155 via the motor driver 155D (S11-005). The steering roller 132 is driven by the stepping motor 155 and is inclined −2° relative to the driving roller 131 (S11-006), so that the fixing belt 105 starts movement from the rear side toward the front side.

That is, when the fixing belt 105 starts a rotational operation from a state of the predetermined temperature or less, the belt shift control means moves the fixing belt 105 in a direction in which the sensor portion 150, which is the detecting means, is disposed. By that arrangement, even when the wax, generated when the toner is fixed, adheres to the sensor flag 150*c* or the sensor arm 150*d* and thus, the sensor portion 105 is hard to rotate, the fixing belt 105 contacts the sensor portion 150 with reliability, so that the belt position can be detected. Thereafter, the sequence goes to the belt shift control (S11-007), and the shift control is carried out.

In the belt shift control, the fixing belt 105 reciprocates between a position (S11-011) in which the first sensor 150*a* is ON, and the second sensor 150*b* is OFF and a position (S11-014) in which the first sensor 150*a* is OFF and the second sensor 150*b* is ON. Swing-type shift control is carried out so that the fixing belt 105 exists in that section (in the predetermined zone). The pressing belt 120 shifts and moves together with the fixing belt 105 with this shift control of the fixing belt 105.

A distance (width) of that section (zone) is ±1.5 mm (reciprocating position) from a center position of the fixing belt 105 with respect to a rotational axis direction of the fixing belt 105 (states S2 and S4). The CPU 10 outputs a predetermined driving pulse to the stepping motor 155 via the motor driver 155D on the basis of the position of the fixing belt 105 detected by the sensor 150 (S11-012 and S11-015). The steering roller 132 is driven by the stepping motor 159 and is inclined ±2° relative to the driving roller 131, so that the control is carried out (S11-013 and S11-016).

Further, in a state in which the shift control is disabled, when the end surface of the fixing belt 105 comes to positions (states S1 and S5) of ±3 mm from the center position, both the first and second sensors 150*a* and 150*b* are OFF (S11-008). At this time, the CPU 10 discriminates that an abnormality occurs (S11-009), and stops a printing operation (image forming operation) of the printer 1 in an emergency. As regards the fixing device 100, electrical power supply to the IH heater 170 is turned off and thus, heating of the fixing belt 105 is stopped, and, at the same time, the driving motor 301 is turned off and thus, rotation of the fixing belt 105 and the pressing roller 120 is stopped (S11-010).

Further, the CPU 10 causes a display portion of a printer operating portion 24 (FIG. 2) to display an abnormality occurrence of the fixing device 100 and thus, prompts a user to contact a service person. In the case of a remote monitoring system, the CPU 10 notifies a service firm of the abnormality occurrence.

During rotation of the driving motor 301, irrespective of the waiting state (stand-by state) or during the fixing operation, the fixing device 100 carries out the above-described series of operations of the shift control (S11-007 to S11-014).

Embodiment 2

Next, Embodiment 2 will be described. FIG. 14 is a flowchart for illustrating shift control of a fixing device 100 in Embodiment 2. Members having the same functions as the members described in Embodiment 1 are represented by same reference numeral and will be omitted from redundant description as long as there is no need to provide such a redundant description.

First, when the power source of the printer 1 is turned on (S14-001), the CPU 10 starts rotation of the driving motor 301 via the motor driver 302D (S14-002). By this arrangement, the fixing belt 105 and the pressing belt 120 rotate.

Then, the CPU 10 checks the temperature of the fixing device 100 (S14-003). Here, when the temperature of the fixing device 100 is greater than a predetermined temperature, the CPU 10 starts the belt shift control (S14-013).

When the temperature of the fixing device 100 is not more than the predetermined temperature, the CPU 10 checks logic of the first sensor 150*a* and the second sensor 150*b* (S14-004). Incidentally, the predetermined temperature in this embodiment is 100° C.

Here, in a case in which the first sensor 150*a* is turned on and the second sensor 150*b* is turned on (state S3 of FIG. 13), the CPU 10 outputs a predetermined driving pulse toward the clockwise direction to the stepping motor 155 via the motor driver 155D (S14-005). The steering roller 132 is driven by the stepping motor 155 and is inclined −2° relative to the driving roller 131 (S14-006). By this arrangement, the fixing belt 105 starts movement from the rear side toward the front side and thus, moves toward the sensor portion 150 provided on the front side.

In a case in which the first sensor 150*a* is OFF and the second sensor 150*b* is ON (S14-007) (state S4 of FIG. 13), the CPU 10 outputs a predetermined driving pulse toward the counter-clockwise direction to the stepping motor 155 via the motor driver 155D (S14-008). The steering roller 132 is driven by the stepping motor 155 and is inclined +2° relative to the driving roller 131 (S14-009), so that the fixing belt 105 starts movement from the front side toward the rear side.

When a predetermined time is elapsed (S14-010), the CPU 10 outputs a predetermined driving pulse toward the clockwise direction to the stepping motor 155 via the motor driver 155D (S14-011). The steering roller 132 is driven by the stepping motor 155 and is inclined −2° relative to the driving roller 131 (S14-012), so that the fixing belt 105 starts movement from the rear side toward the front side.

By this series of operations, even when the wax adheres to the sensor flag 150*c* or the sensor arm 150*d* and thus, the sensor portion 105 is hard to rotate, the fixing belt 105 contacts the sensor portion 150 with reliability, so that the belt position can be detected. Thereafter, the sequence goes to the belt shift control (S11-013), and the shift control is carried out.

In the belt shift control, the fixing belt 105 reciprocates between a position (S14-017) in which the first sensor 150*a* is ON, and the second sensor 150*b* is OFF, and a position (S14-020) in which the first sensor 150*a* is OFF and the second sensor 150*b* is ON. Swing-type shift control is carried out so that the fixing belt 105 exists in that section. The pressing belt 120 shifts and moves together with the fixing belt 105 with this shift control of the fixing belt 105.

A distance of that section is ±1.5 mm from a center position of the fixing belt 105 with respect to a rotational axis direction of the fixing belt 105 (states S2 and S4). The CPU 10 outputs a predetermined driving pulse to the stepping motor 155 via the motor driver 155D on the basis of the position of the fixing belt 105 detected by the sensor 150 (S14-018 and S14-021). The steering roller 132 is driven by the stepping motor 159 and is inclined ±2° relative to the driving roller 131, so that the control is carried out (S14-019 and S14-022).

The control of the above-described flowchart shown in FIG. 14 in this embodiment is summarized. When the rotational operation is started from the temperature of the fixing belt 105, which is not more than the predetermined temperature, the belt shift control means carries out the following control. By this arrangement, even when the wax adheres to the sensor flag 150*c* or the sensor arm 150*d* and thus, the sensor portion 105 is hard to rotate, the fixing belt 105 contacts the sensor portion 150 with reliability, so that the belt position can be detected.

(1) In a case in which the fixing belt 105 is discriminated as being not in the reciprocating position on one side or the other side in the predetermined zone, and in a case in which detection that the fixing belt is positioned on a side opposite from the side on which the sensor portion 150 is provided is made, the belt is moved in a direction in which the sensor portion is disposed. That is, the CPU 10 controls the steering roller 132 by inclining the steering roller 132 in a direction in which the fixing belt 105 is moved toward the side on which the sensor portion 150 is disposed.

(2) In a case in which detection that the fixing belt 104 is positioned on the side on which the sensor portion 150 is provided is made, after the fixing belt is moved for a predetermined time toward a side opposite from the side on which the sensor portion is provided, the fixing belt is moved in the direction in which the sensor portion is disposed. That is, the CPU 10 controls the steering roller 132 by inclining the steering roller 132 for a predetermined time in a direction in which the fixing belt 105 moves toward the side opposite from the side on which the sensor portion 150 is disposed. Thereafter, the CPU 10 controls the steering roller 132 by inclining the steering roller 132 in the direction in which the fixing belt 105 moves toward the side on which the sensor portion 150 is disposed.

Further, in a state in which the shift control is disabled, when the end surface of the fixing belt 105 comes to positions (states S1 and S5) of ±3 mm from the center position, both the first and second sensors 150*a* and 150*b* are OFF (S14-014). At this time, the CPU 10 discriminates that abnormality occurs (S14-015), and stops a printing operation (image forming operation) of the printer 1 in an emergency. As regards the fixing device 100, electrical power supply to the IH heater 170 is turned off and thus, heating of the fixing belt 105 is stopped, and, at the same time, the driving motor 301 is turned off and thus, rotation of the fixing belt 105 and the pressing roller 120 is stopped (S14-016).

Further, the CPU 10 causes a display portion of a printer operating portion 24 (FIG. 2) to display an abnormality occurrence of the fixing device 100 and thus, prompts a user to contact a service person. In the case of a remote monitoring system, the CPU 10 notifies a service firm of the abnormality occurrence.

During rotation of the driving motor 301, irrespective of the waiting state (stand-by state) or during the fixing operation, the fixing device 100 carries out the above-described series of operations of the shift control (S14-013 and S14-022).

Other Matters (1) In the fixing devices of the embodiments described above, the reciprocating control by the position detecting means 150 and the reciprocating control means was described using the fixing belt 105 as a representative. Also, as regards the pressing belt 120, it is possible to carry out the reciprocating control by the position detecting means and the reciprocating control means similar to those for the fixing belt 105.

(2) The fixing devices in the embodiments described above are devices in which both of the first and second rotatable fixing members are endless belts, but it is also possible to use a device in which either one of the first and second rotatable fixing members is the endless belt and the other member is a roller member.

(3) In the embodiments described above, as an example, the fixing device for fixing the unfixed toner image t on the sheet S was described. The present invention is not, however, limited thereto, and is also similarly applicable to a device for heating and pressing a toner image, fixed or temporarily fixed on the sheet, in order to improve glossiness of the image (also in this case, the device is called the fixing device).

(4) Further, as the heating mechanism, the electromagnetic induction heating type was described, but the present invention is not limited thereto, and is also similarly applicable to a case in which a heating mechanism of another type, such as a halogen heater, is used. Specifically, for example, the heating mechanism, such as the halogen heater, is provided inside the driving roller 131 or the pressing roller 121.

INDUSTRIAL APPLICABILITY

According to one aspect, the present invention provides an image forming apparatus including a fixing device provided with an endless belt.

The invention claimed is:

1. A fixing device comprising:

a pair of rotatable members forming a nip for fixing a toner image on a recording material, wherein at least one of said rotatable members is an endless belt;

a roller for rotatably supporting said endless belt;

a detecting device including a contact portion contacting one end of said endless belt with respect to a widthwise direction, an urging portion for urging said contact portion toward the one end of said endless belt with respect to the widthwise direction, and a sensor for detecting a position of said contact portion, wherein said detecting device detects a position of said endless belt with respect to the widthwise direction depending on an output of said sensor; and a displacing device for displacing one end of said roller with respect to a longitudinal direction depending on the position of said endless belt detected by said detecting device, wherein, before rotation of said endless belt is started, said displacing device displaces the one end of said roller with respect to the longitudinal direction so that said contact portion moves against an urging force of said urging portion upon the start.

2. The fixing device according to claim 1, wherein, in a period from a start of rotation of said endless belt until said sensor detects the position of said contact portion, said displacing device displaces the one end of said roller with respect to the longitudinal direction so that said contact portion moves against the urging force of said urging portion.

3. The fixing device according to claim 2, wherein said detecting device includes a rotatable portion rotatable in interrelation with movement of said contact portion, and said sensor includes a photo-interrupter capable of being light-blocked by said rotatable portion.

4. The fixing device according to claim 3, wherein, in a case in which said sensor is light-blocked by said rotatable portion in a period from the start of rotation of said endless belt until a lapse of a predetermined time, rotation of said endless belt is stopped.

* * * * *